US010544612B1

(12) United States Patent
Jones

(10) Patent No.: US 10,544,612 B1
(45) Date of Patent: Jan. 28, 2020

(54) GRAVITY POWERED GARAGE DOOR CONTROL SYSTEM AND METHOD

(71) Applicant: Charles M. Jones, Woodridge, IL (US)

(72) Inventor: Charles M. Jones, Woodridge, IL (US)

( * ) Notice: Subject to any disclaimer, the term of this patent is extended or adjusted under 35 U.S.C. 154(b) by 0 days.

(21) Appl. No.: 16/010,689

(22) Filed: Jun. 18, 2018

(51) Int. Cl.

| | |
|---|---|
| ***E05F 1/02*** | (2006.01) |
| ***E05F 1/04*** | (2006.01) |
| ***E05F 15/60*** | (2015.01) |
| ***E05B 65/00*** | (2006.01) |
| ***E05F 15/73*** | (2015.01) |

(52) U.S. Cl.
CPC ..... *E05F 1/02* (2013.01); *E05B 65/0021* (2013.01); *E05F 1/04* (2013.01); *E05F 15/60* (2015.01); *E05F 15/73* (2015.01); *E05Y 2900/106* (2013.01)

(58) Field of Classification Search
CPC ..... E05B 65/0021; E05F 1/02; E05F 15/59; E05F 3/222
USPC ..... 49/21–23
See application file for complete search history.

(56) References Cited

U.S. PATENT DOCUMENTS

2017/0321467 A1* 11/2017 Okrasa ..... E05F 15/59

OTHER PUBLICATIONS https://garagespot.com/hydradoor-water-powered-garage-door-opener/, published Feb. 28, 2017, internet (Year: 2017).*
Masoumi et al., Elevator was Worked by Water and Water Pump, internet, available at http://maxwellsci.com/print/rjaset/v4-5557-5560.pdf, Dec. 15, 2012 (Year: 2012).*
https://garagespot.com/hydradoor-water-powered-garage-door-opener/ Published Feb. 28, 2017 Internet.

* cited by examiner

*Primary Examiner* — Michael C McCullough

(57) ABSTRACT

A gravity powered garage door control opening and closing system that eliminates the conventional electric garage door opener and eliminates its two most common risks of failure, the first being a gear and/or bearing failure and the second being an electrical power failure. Other advantages include a reduction in electrical power needed and a reduction in cost over every other type of garage door opener. The present invention operates by transferring fluid between a counter weight and a storage tank under programmed control to control the movement and speed of the garage door as a function of its position in the door guides in which the door moves in.

24 Claims, 9 Drawing Sheets

GRAVITY POWERED GARAGE DOOR CONTROL SYSTEM AND METHOD

BACKGROUND

A garage door is a large door on a garage that opens either manually or by an electric motor (a garage door opener) to accommodate automobiles and other vehicles.

In 1926 C. G. Johnson invented the garage door opener. Early electric garage door openers were operated remotely, but not wirelessly. There would be two wired switches, one a keypad outside and the other a switch inside the garage.

As reported in the February 1931 issue of Popular Science, two widely separate teams came up with the idea of a radio-controlled garage door opener.

One used a code pulse system, while the other simply generated white noise on the right frequency to activate. As living spaces became more dense, the white noise system frequently caused the neighbors garage door to open.

The code pulse system soon became the standard. Currently remote garage door openers use a frequency spectrum range between 300-400 MHz and most of the transmitter/receivers rely on hopping or rolling code technology.

A number of people in the United States have suffered death or injury at the mercy of garage door openers with inadequate safety measures.

Many were children. In 1933 the federal government reacted by passing a federal law requiring a minimum level of safety for all garage door openers. The law was effective and since then very few garage door injuries have been repeated.

There are five types of garage door openers. Chain drive, belt drive, screw drive, direct drive, and jackshaft.

Chain drive openers have a chain (similar to a bicycle's) that connects the trolley to the motor.

Belt drive openers use a rubber belt in place of a chain.

Screw drive openers have a long screw inside the track. A trolley connects to this screw.

Direct drive openers have the motor installed inside the trolley and use a gear wheel to guide the trolley along a fixed chain.

Jackshaft openers mount on the wall at either end of the torsion bar. This style of opener consists of a motor that attaches to the side of the torsion rod and moves the door up and down by simply spinning the rod. These openers need a few extra components to function safely for residential use.

Currently, the predominate garage door opening/closing control system in the United States is an electric opener using a Chain drive or a Belt drive to open the garage door. There are a few experimental systems such as a hydraulic cylinder system and even hydraulic system that uses water instead of hydraulic fluid to cause a garage door to open.

SUMMARY OF THE PRESENT SYSTEM

The use of counter weights to offset the weight of a door (horizontal or vertical) is not new. However, a control system for opening/closing counter weighted garage doors that eliminates the electrical garage door opener and does not require hydraulic cylinders is new. The present invention uses a holding tank and a weight container to transfer a fluid, via hoses, between them to vary the weight in the weight container under program control. One end of a cable is attached to the weight container while the other end is attached to the garage door. The cable typically runs through pulleys to allow the weight container to move up and down, as the fluid weight is changed it causes the garage door to move in the opposite direction. The weight container, full of fluid, weighs more than the garage door so it can easily open the garage door by gravity alone. The weight container, empty of fluid, weighs nothing, compared to the garage door so the garage door will close by gravity alone.

With no other controls, the garage door would slam open and slam shut. The present invention is a programmable control system that allows a fast initial response by the garage door without slamming at either end of its travel range by moving some fluid out of the weight container while the door is still opening and moving some fluid into the weight container while the door is still closing. The removal of fluid while the door is opening causes a relatively gentle landing in the opened or closed position. The door position to start/stop transferring fluid is pre-determined in the setup process. The amount of fluid in the weight container, which stores potential energy to start the door movement, is also pre-determined in the setup process.

PRIOR ART

Figure 1A:
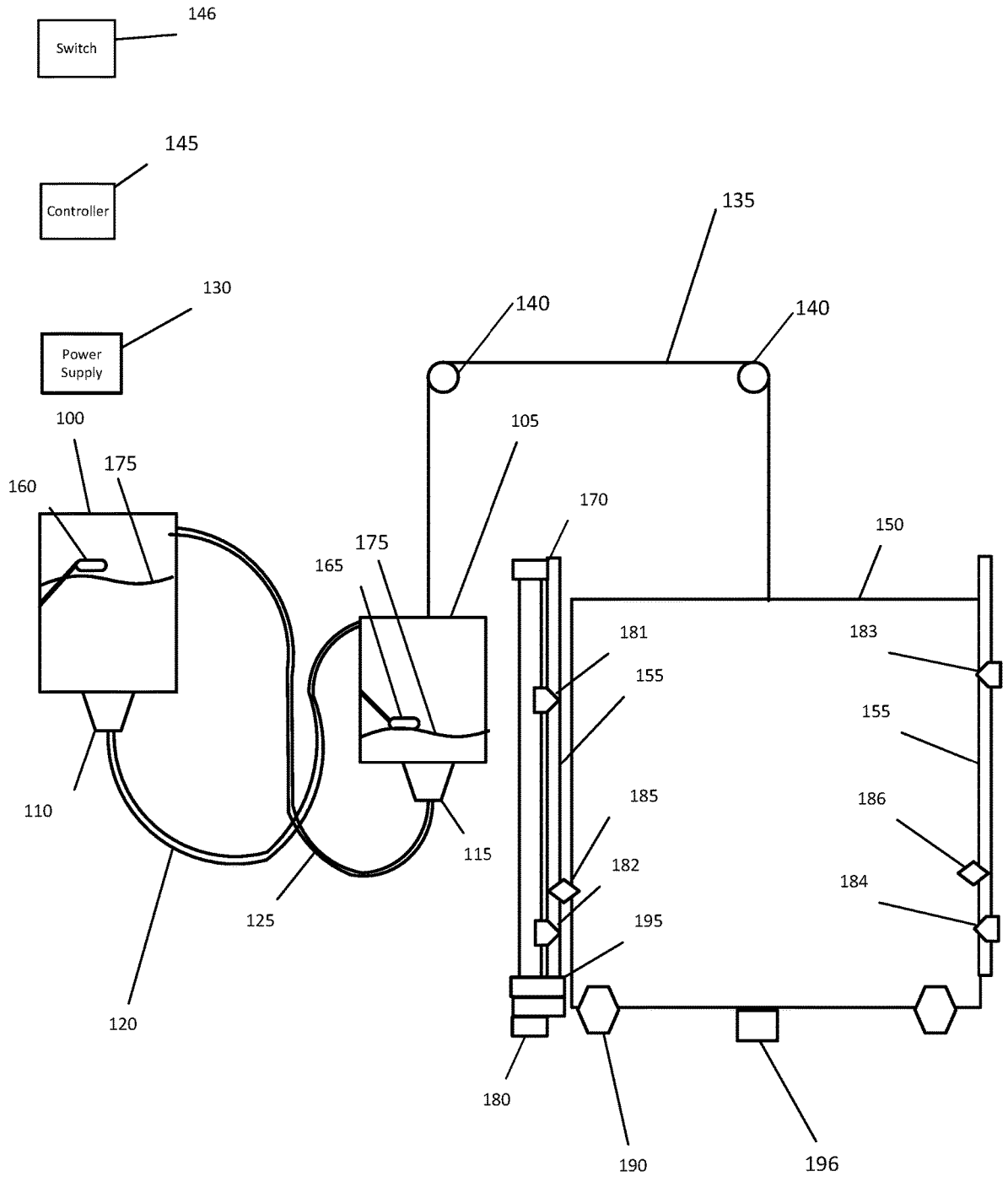
FIG. 1 A is a schematic sketch of the physical components of the gravity powered garage door control system with two one way fluid pumps.
FIG. 1B is a schematic sketch of the physical components of the gravity powered garage door control system with one reversible fluid pump.

A Water-Powered Garage Door Opener hydraulic system was described at: https://garagespot.com/hydradoor-water-powered-garage-door-opener/

Lexicon of Terms and Abbreviation

Weight Balance Point—The approximate height of the weight container when the door is balanced at approximately half opened and half closed Holding Tank—A tank, typically attached to a wall, for holding the fluid when the fluid is not in the weight container.

Weight Container—A tank that acts as a counterbalance to the garage door.

Holding Pump—A one-directional pump for transferring the fluid from the holding tank to the weight container.

Weight Pump—A one-directional pump for transferring the fluid from the weight container to the holding tank.

Reversible Pump—A pump for transferring the fluid between the weight container and the holding tank.

Holding Hose—A two directional fluid transfer tube connecting the holding pump to the weight container.

Weight Hose—A fluid transfer tube connecting the weight pump to the holding tank.

Power Supply=A source of appropriate electricity, low voltage or normal house current, for powering the pumps, the sensors, and the solenoids.

Cable—A cable of sufficient strength to hold and quickly lift the door.

Cable Guide—An arrangement of pulleys to cause the door to lift when the weight container descends and to cause the door to lower when the weight container ascends.

Controller—An apparatus that controls the operation of the Gravity Powered Garage Door. The apparatus may be mechanical with adjustable sensors on control rods or it may be electrical with a memory to store the setup settings.

Switch—A switching mechanism to signal the controller to open/close the door. The switch may be wired or wireless.

Door—A conventional garage door of any type of heavy door or gate that may benefit from a control system.

Door Guide—The tracks or guides that the door movement is limited to when opening or closing.

Holding Level Sensor—A float, or other, type sensor able to report the fluid level in the holding tank.

Weight Level Sensor—A float, or other, type sensor able to report the fluid level in the weight container.

Door Opened Lock—A lock that holds the door in the opened position and is able to be unlocked with a signal from the controller.

Door Closed Lock—A lock that holds the door in the opened position and is able to be locked with a signal from the controller.

Speed Reducing Apparatus—A shock absorbing device to soften the opening and closing of the door just before being locked in the opened or closed position.

Emergency Brake—A braking device to stop the movement of the door in its current position when signaled by the controller.

Obstacle Detector—A sensor incorporated in the bottom edge of the door to detect an obstacle while the door is closing CS—Closing Start: The approximate position of a closing door when fluid starts being pumped into the weight container (to slow down the door speed before reaching the closed position).

CE—Closing End: The approximate position of a closing door when fluid stops being pumped into the weight container (to slow down the door speed before reaching the closed position).

OS—Opening Start:—The approximate position of an opening door when fluid starts being pumped out of the weight container (to slow down the door speed before reaching the opened position).

OE—Opening end:—The approximate position of an opening door when fluid stops being pumped out of the weight container (to slow down the door speed before reaching the opened position).

Emergency Door Opening Tank—A fluid holding tank able to quickly dump the fluid through the emergency hose, when the emergency release valve is opened, into the weight container to quickly open the door in an emergency.

Triggers—A lever on the door for tripping the trip switches.

Trip Switches—The on/off switches, adjustable attached to the door guides which are tripped by the triggers indicating a predefined position of the door to start or stop transferring fluid.

First Predetermined Level—(Lo) the fluid level in the weight container when the door is in the opened position.

Second Predetermined Level—(Lc) the fluid level in the weight container when the door is in the closed position.

Lo—First Predetermined Level

Lc—Second Predetermined Level

NUMERAL REFERENCES

100 Holding Tank
105 Weight Container
106 First Predetermined Level (Lo)
107 Second Predetermined Level (Lc)
110 Holding Pump
115 Weight Pump
117 Reversible Pump
120 Holding Hose
125 Weight Hose
130 Power Supply
135 Cable
140 Cable Guide
145 Controller
146 Switch
150 Door
155 Door Guide
160 Holding Level Sensor
165 Weight Level Sensor
170 Door Opened Lock
175 Fluid
180 Door Closed Lock
181 First Trip Switch
182 Second Trip Switch
183 Third Trip Switch
184 Fourth Trip Switch
185 First Trigger
186 Second Trigger
190 Speed Reducing Apparatus
195 Emergency Brake
196 Obstacle Detector
197 Emergency door opening tank
198 Emergency release valve
199 Emergency hose
200 Is the system test OK?
205 Is the door closed lock locked?
210 Read the door position
215 Pump fluid from weight container to holding tank
220 Stop pumping fluid
230 Is the door opened lock locked?
240 Transfer fluid between the weight container and the holding tank
260 Pump fluid from holding tank to weight container
270 Is the weight container full?
300 Is the system test OK?
305 Is the door opened lock locked?
310 Read the door position
315 Pump fluid from the holding tank to the weight container
320 Stop pumping fluid
330 Is the door closed lock locked?
340 Transfer fluid between holding tank and the weight container

360 Pump fluid from the weight container to the holding tank
370 Is the weight container full?
520 Determine OS, OE, CS, CE, Lo and Lc
530 Is the door movement satisfactory?
540 Store OS, OE, CS and CE
610 Calculate Total Fluid
620 Is Total Fluid >=MINTF and <=MAXTF
630 is Holding pump OK?
640 Is Weight pump OK?
650 Is Obstacle detector OK?
660 System Test OK?
670 System Test Not OK
720 Closing Start (CS)—The first trip switch
730 Closing End (CE)—The second trip switch
740 Opening Start (OS)—The third trip switch
750 Opening end (OE)—The fourth trip switch

DETAILED DESCRIPTION OF THE PRESENT INVENTION

The present invention, as seen in FIG. 1A, consists of a holding tank 100 typically fixed to a wall and a weight container 105 typically hung by one end of a cable 135. The opposite end of the cable is attached to a garage door 150. The cable passes through cable guides 140 which are typically pulleys. The pulley arrangement could be designed to produce a one-to-one opposite movement between the weight container and the garage door, or they could be set up with a mechanical advantage. There are typically two pumps, the holding pump 110 which transfers fluid from the holding tank 100 to the weight container 105 via a Holding hose 120. The second pump is a weight pump 115 which transfers fluid 175 from the weight container 105 to the holding tank 100 via a weight hose 125. The cable passes over/through cable guides 140 which are typically an arrangement of pulleys that cause vertical movement of the weight container and of the garage door. The holding tank has a holding level sensor 160 for reporting the fluid level in the holding tank to the controller 145. The weight container has a weight level sensor 165 for reporting the fluid level in the weight container to the controller. A power supply 130 provides power to the controller and to the Holding pump 110 and to the holding pump 115. The power may be conventional house power, i.e. 110 volts as in the United States, or preferable low voltage power supplied from a battery. The battery may be charged by a battery charger that is plugged into conventional power. This setup guarantees that the garage door system will still function even if the power fails. The other advantage of low power components, such as the fluid pumps, is that they are more economical than higher voltage fluid pumps. One of the pumps could be replaced by a two way (reversible) pump 1170.

The door 150 movement is guided by door guides 155. There is a door closed lock 180 that automatically engages when the door is moved to the closed position. When a signal is send by the switch 146 and received by the controller to open the closed door, a command is sent to the door by the controller to the door closed lock to open/release the door closed lock and start opening the door. The door closed lock is important for two reasons. First it prevents an intruder from prying open the closed garage door. Second it holds the garage door in the closed position while fluid is being pumped into the weight container (to store potential energy) in order to anticipate a door open command. The stored potential energy allows the door to open quickly, at first, while the fluid is slowly being removed from the weight container under programmed control to insure a gentle landing when the door opened lock 170 automatically engages. The door opened lock is also important because it holds the door open while fluid 175 is slowly being removed from the weight container which would allow the weight of the door to serve as potential energy for a fast start to the door closing. A door position sensor 185 continually reports the current position of the door back to the controller 145.

A speed reducing apparatus 190 provides a shock absorbing action to the door movement to insure that a heavy door does not slam when reaching the closed position. This might occur while setting up the control system.

An emergency brake 195 causes the door closing movement to stop abruptly when a resistance is felt during the closing of the door and/or when an obstacle detector 196, such as a pressure sensor and/or an infra-red garage door safety sensor, indicates that an obstruction to the door closing is present.

Figure 1B:
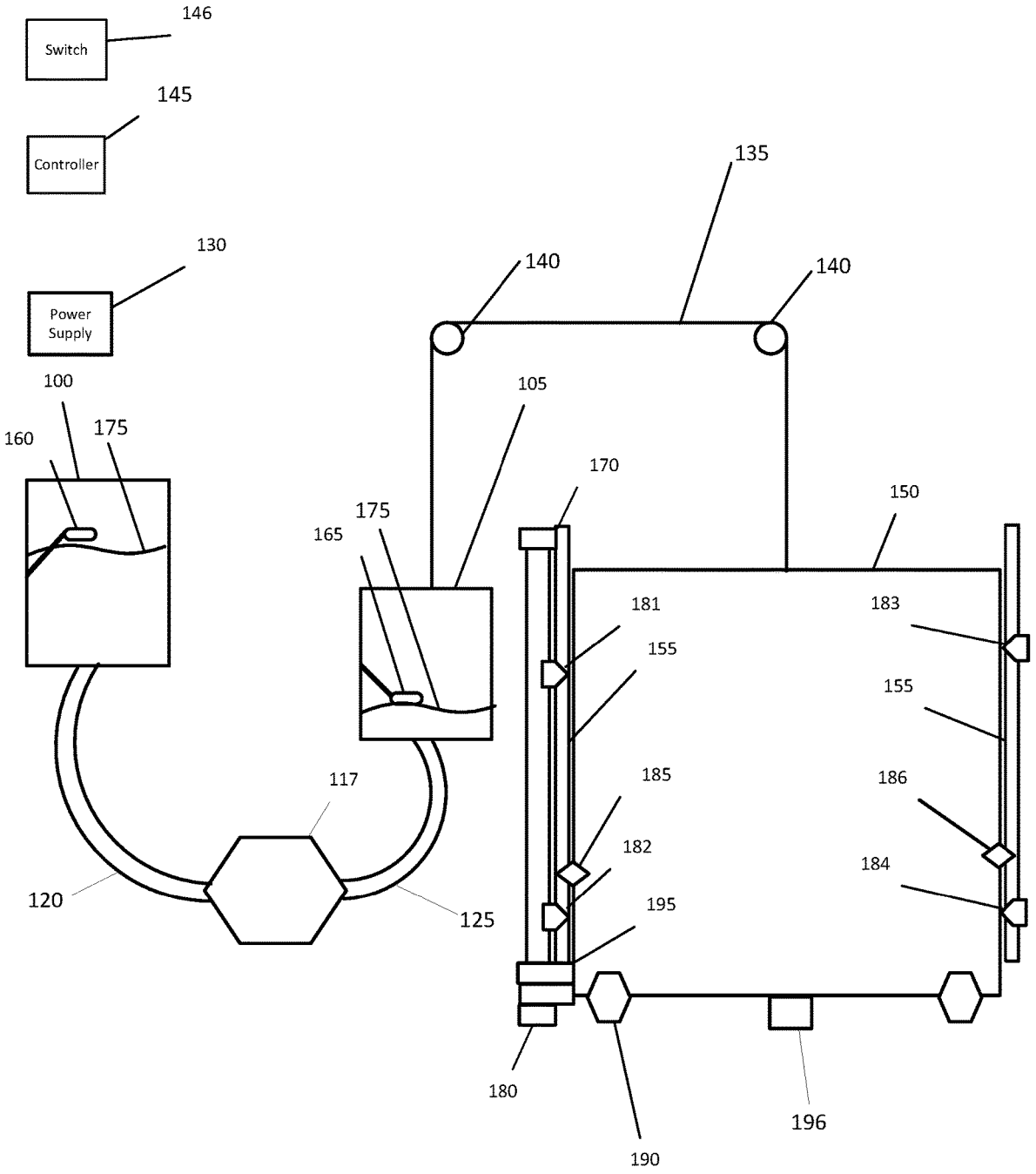

FIG. 1B is a variation of the components needed for the system. The holding pump and the weight pump (which are one-way pumps) are replaced with one reversible pump 117. The holding hose 120 connects the bottom of the holding tank to one end of the reversible pump. The weight hose 115 connects the bottom of the weight container to the other end of the reversible pump. The comparable costs of one reversible pump verses two one-way pumps are a factor in which variation of the components to use in the system.

Figure 2:
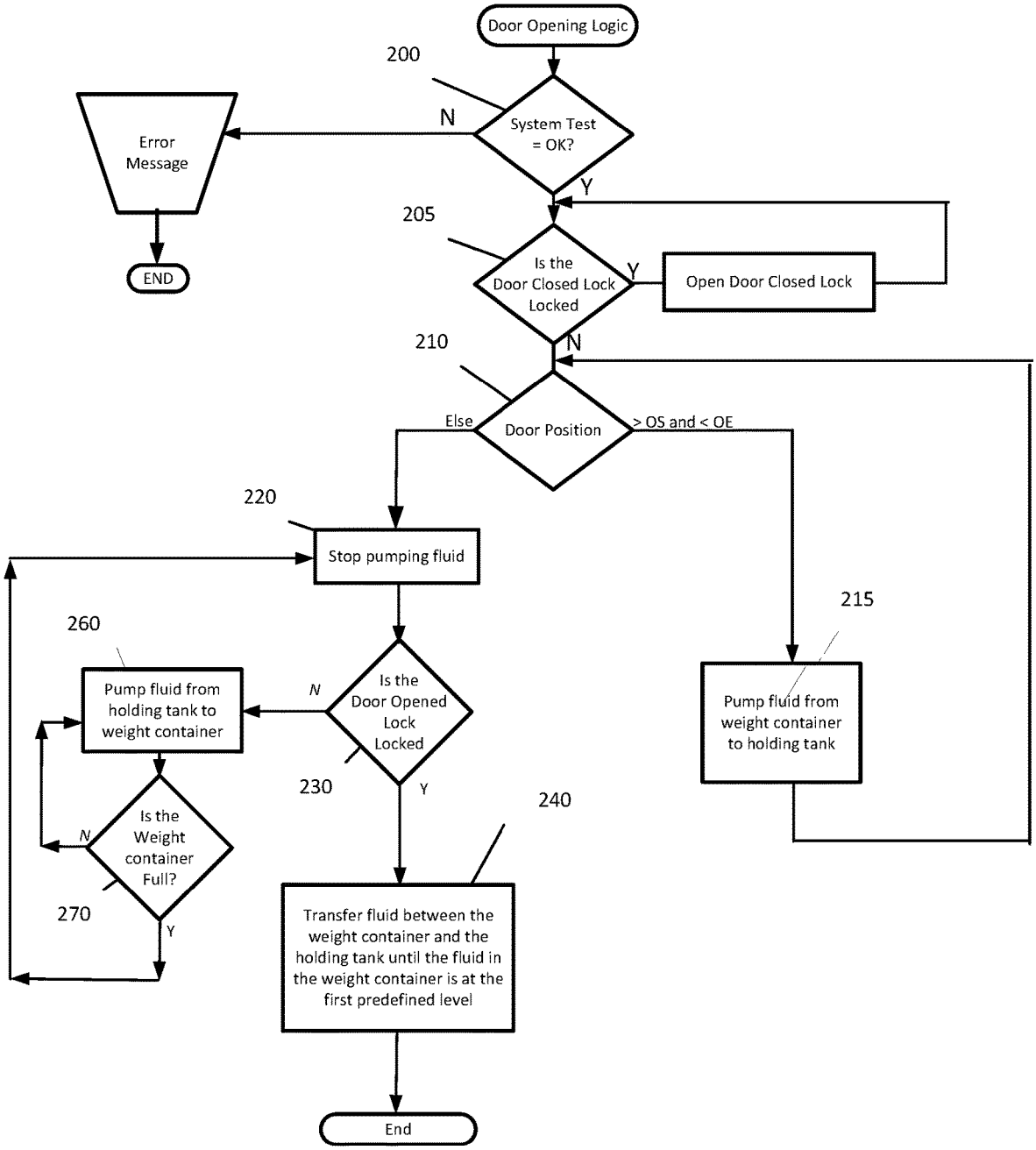
FIG. 2 is a flow chart of a logic followed by the controller when opening the garage door.
Figure 6:
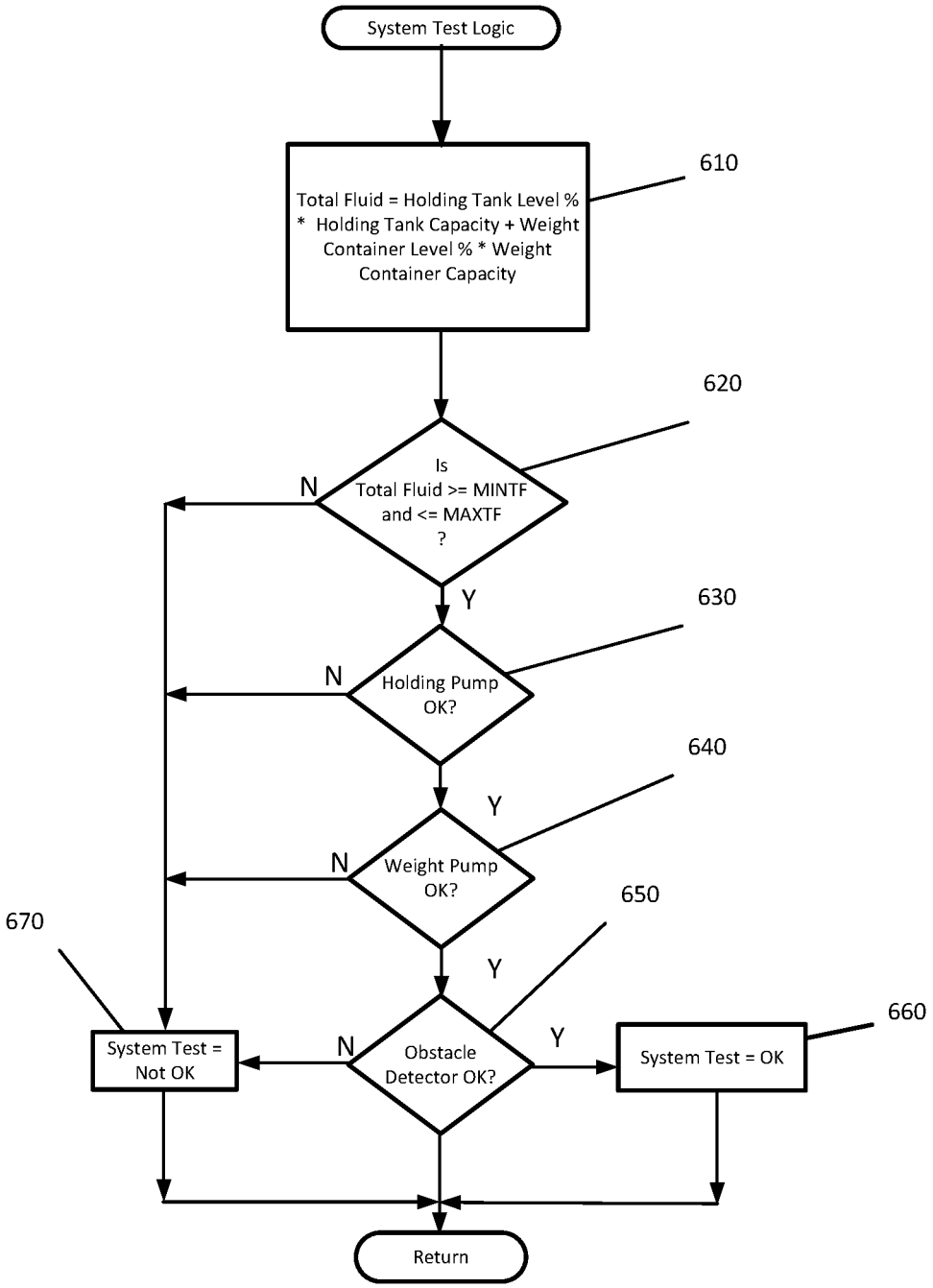
FIG. 6 is a flow chart of a System testing logic.

FIG. 2 is a logic flow chart of one possible programmed control of the opening of the gravity powered garage door. If the system is tested 200 every time that it is used then the test, as seen in FIG. 6, is done first. Once the operation of the components is verified then the door opening logic continues. The door is assumed closed and locked, so the first step is to check if the door closed lock is locked 205. If so then it is opened. Next a check is made to see if the door position 210 is between OS and OE. If it is between OS and OE then 215 fluid is pumped from the weight container to the holding tank. Otherwise, 220 stop pumping fluid. Once the door is confirmed opened 230 and locked fluid is pumped from the weight container to the holding tank 240. If the weight container is empty 250 then the opening process is complete else return to 230. If the door opened lock is not locked 230 then 260 pump fluid from the holding tank to the weight container. When the weight container is full then stop pumping fluid 220.

Figure 3:
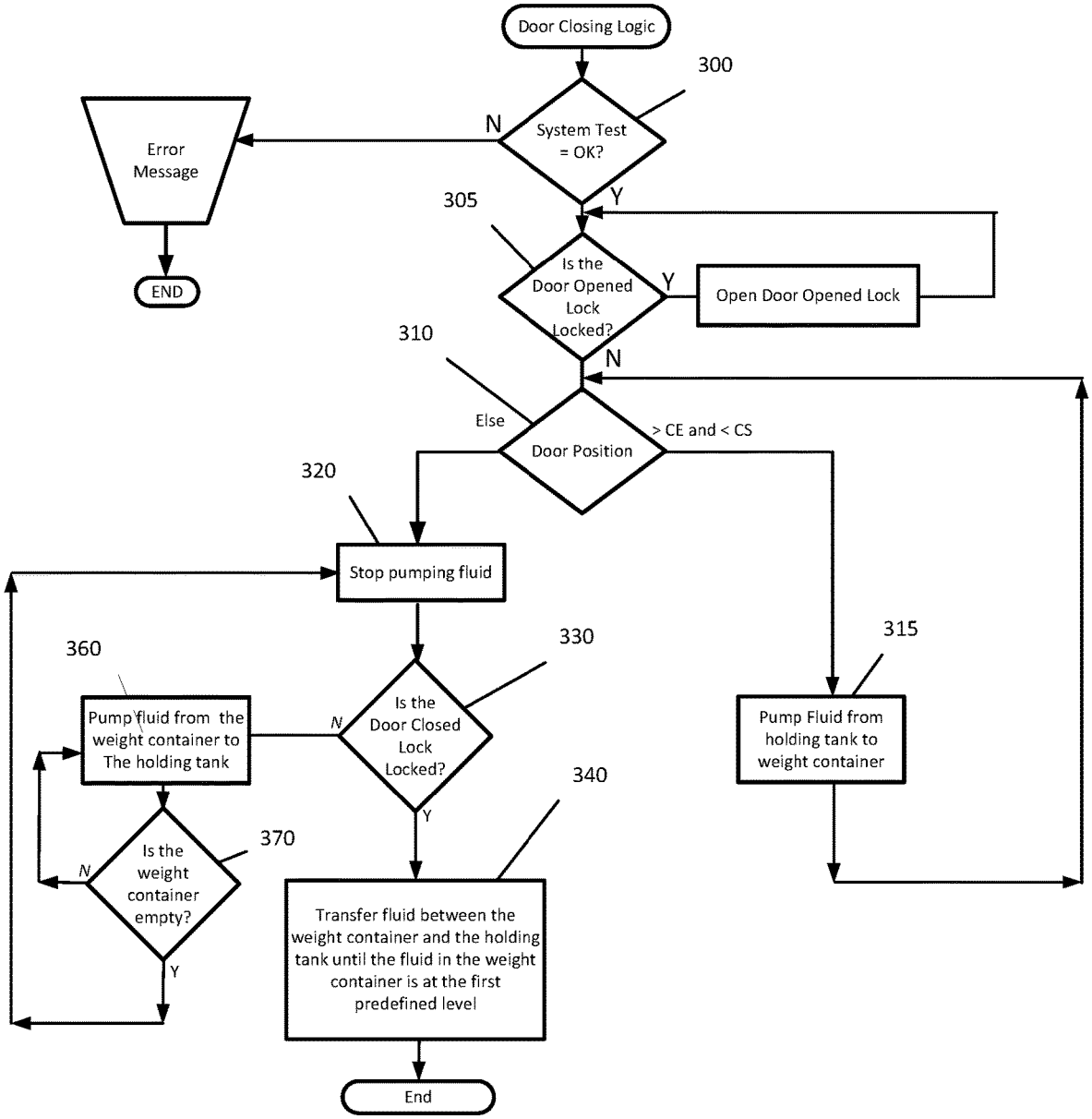
FIG. 3 is a flow chart of a logic followed by the controller when closing the garage door.

FIG. 3 is a logic flow chart of one possible programmed control of the closing of the gravity powered garage door. If the system is tested every time that it is used then the test 300, as seen in FIG. 6, is done first. Once the operation of the components is verified then the door closing logic continues. The door is assumed opened and locked, so the first step is to check if the door opened lock is locked 305. If so then it is opened. Next a check is made to see if the door position 310 is between OS and OE. If it is between OS and OE then 315 fluid is pumped from the holding tank to the weight container. Otherwise, 320 stop pumping fluid. Once the door is confirmed closed and locked 330 then fluid is pumped from the holding tank to the weight container 340. If the weight container is full 350 then the closing process is complete else return to 340. If the door closed lock is not locked 330 then pump fluid from the weight container to the holding tank 360. When the weight container is empty then stop pumping fluid 320.

Figure 4:
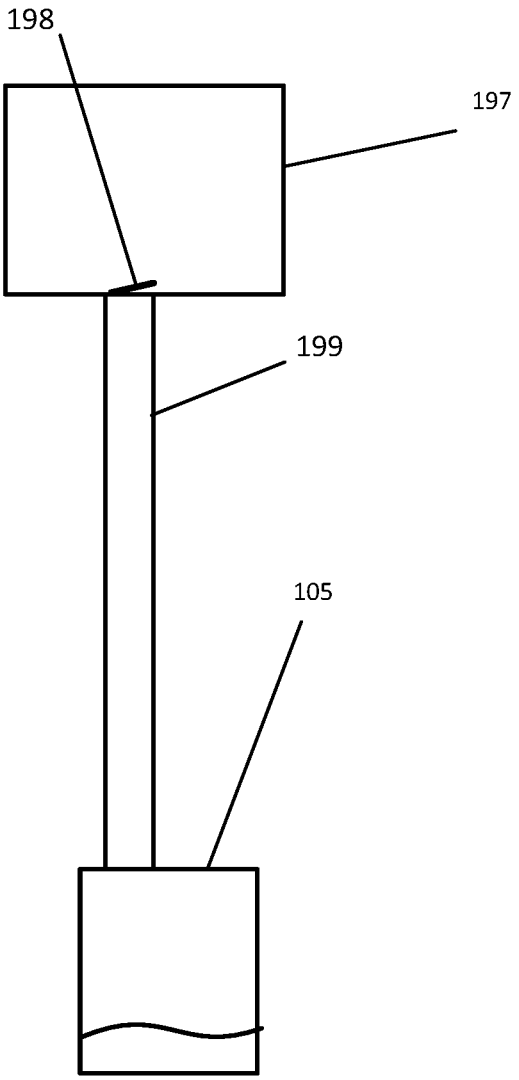
FIG. 4 is a schematic sketch of the physical components of the gravity powered garage door control system with an emergency door opening apparatus.

As seen in FIG. 4, an emergency door opening apparatus is a high volume water based apparatus which consists of an emergency door opening tank 197 which is typically attached high on a wall or to the ceiling. An emergency hose 199 that connects the emergency braking tank to the weight container is of a much greater inside diameter than the holding hose and the weight hose in order to cause a large volume of fluid to surge into the weight container causing the door to quickly open. An emergency release valve 198 releases the fluid from the emergency braking tank and allows gravity to force a large fluid volume quickly into the weight container in order to quickly open the door.

The door closed lock 180 and the door opened lock 170 includes a solenoid that is able to lock or release the lock when directed to do so by the controller.

Numerous variations of the pumps could be utilized. The pumps may be of a conventional impeller driven style or they may consist of an inflatable bladder to a pressurized gas supply, the bladder designed and arranged so that when the bladder is inflated with the gas, the fluid is displaced causing the fluid to be transferred out of its container. The bladder could be eliminated and the gas (including compressed air) could be injected directly above the fluid in the holding tank and the weight container to force the fluid out. Compressed air, or other gas, could also be injected directly into the emergency door opening tank to increase the speed that the fluid transfers to the weight container in an emergency door opening.

The fluid that is transferred between the holding container and the weight tank is typically water, however other fluids may be used. Various ingredients may be added to the fluid, such as antifreeze for operation in cold climates, oil for lubricating for any moving parts and rust inhibitors for preventing oxidation of any parts.

The fluid is transferred with relatively small pumps that operate on a battery and kept charged with a trickle charger. This eliminates the risk of power failures. This also keeps the cost of the system low. Since the present invention also eliminates the electrical garage door opener, the present invention also eliminates the risk of a bearing or gear failing which is common in garage door openers.

The present invention can be controlled by a conventional wired switch (inside and/or outside) and/or by a conventional remote wireless switch. Both types of switches communicate with the controller to cause the desired garage door movement.

Figure 7:
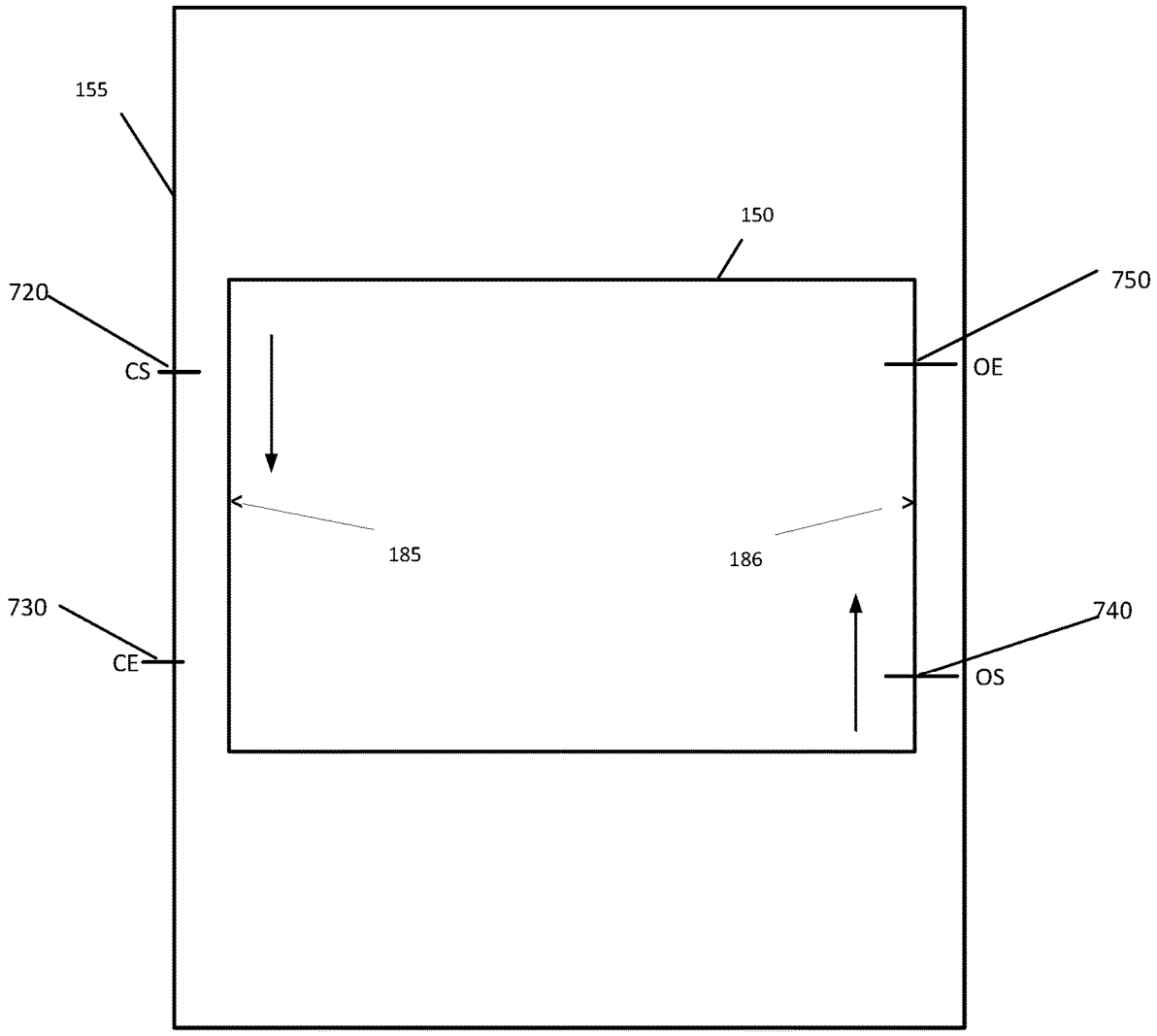
FIG. 7 is a schematic sketch of an example of the door position at the CS, CE, OS and OE points on the door guides. The CS, CE, OS and OE points are determined during the setup process. When the first trigger lines up with the CS or CE points, or the second trigger lines up with the OS or OE points, then the controller causes some action to occur.

There are many variations of the programmed control of the garage door control system and method. FIGS. 2 and 3 illustrates one of these variations. Even within the logic of FIGS. 1 and 2 are many variations. An example is the placement of the closing start (CS) 720, the closing end (CE) 730, the opening start (OS) 740 and the opening end (OE) 750 positions as seen in FIG. 7. When the CS or the CE trip switches on the door guides line up with the first trigger 185 then pumping activity starts or stops. When the OS or the OE trip switches on the door guides line up with the second trigger 186 then pumping activity also starts or stops.

Figure 5:
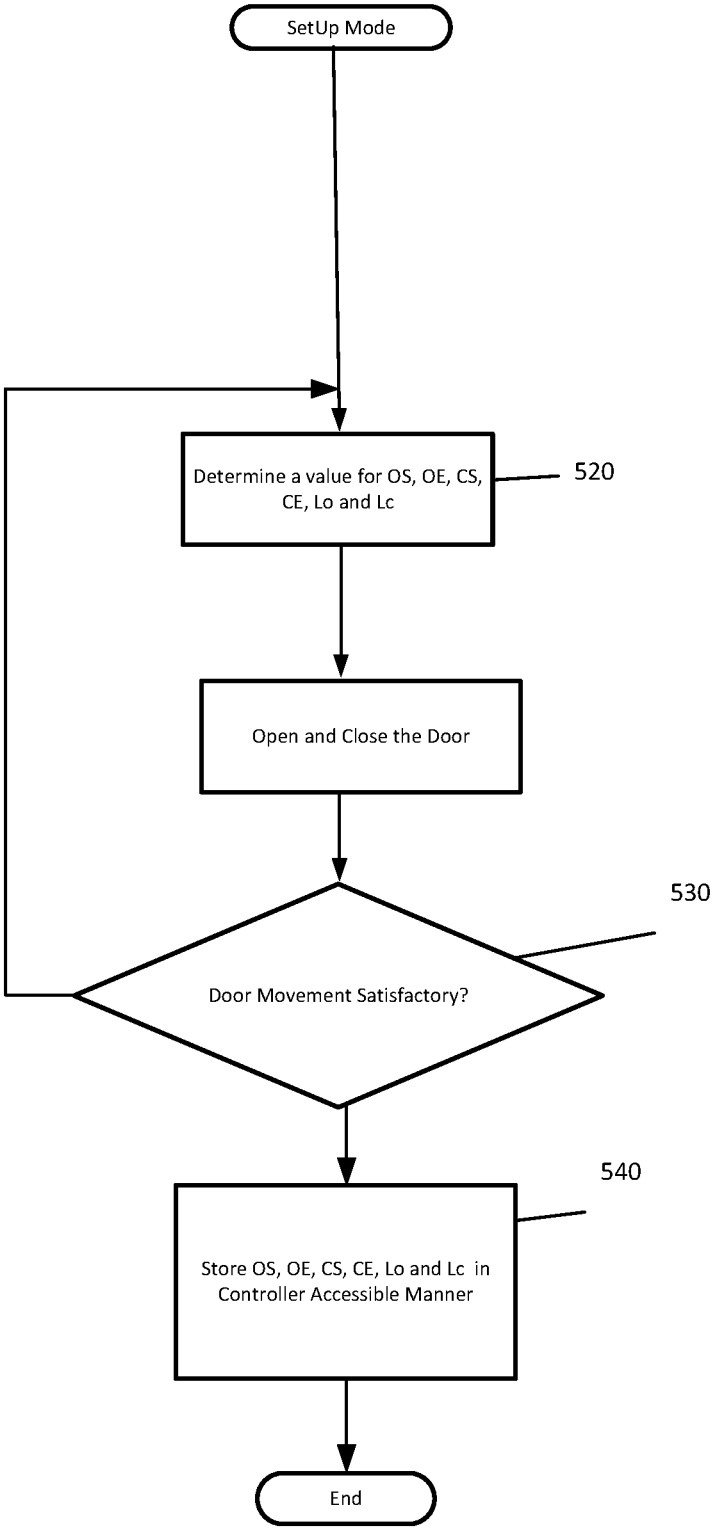
FIG. 5 is a flow chart of a Setup process.

The setup mode, as seen in FIG. 5, consists of finding the CS, CE, OS and OE positions 520. The setup mode is complete when the values of CS, CE, OS and OE have been determined 530 and stored in a manner that is accessible to the controller 540. The manner of storage could be a setting on a set of dials or it could be digital values stored in a memory.

The values of minimum total fluid in the system (MINTF) and maximum total fluid in the system (MAXTF) are validated and also stored in a manner that is accessible to the controller. Once the setup is complete the system is ready for the operational mode.

The system components may be tested periodically or every time that the system is used. The system test logic is seen in FIG. 6. The total fluid volume is measured from the holding tank level sensor and the weight container sensor 610. The total fluid is then checked to be sure that it is in the range between the values of MINTF and MAXTF 620. If the holding pump 630 and weight pump 640 and the obstacle detector 650 also tests as OK then the system test is passed 660. If the system test fails 670 then a warning message is communicated and the system does not operate. If the hoses are deemed to hold a significant volume of fluid, then that volume could be included in the total fluid calculations.

The schematic sketch, in FIG. 7, is an example of the placement of the closing start (CS) 720, closing end (CE) 730, opening start (OS) 740, and the opening end (OE) 750 door positions on the door guides. These points line up with the pointer on door 700 when the door is in the desired position for each setting.

Figure 8:
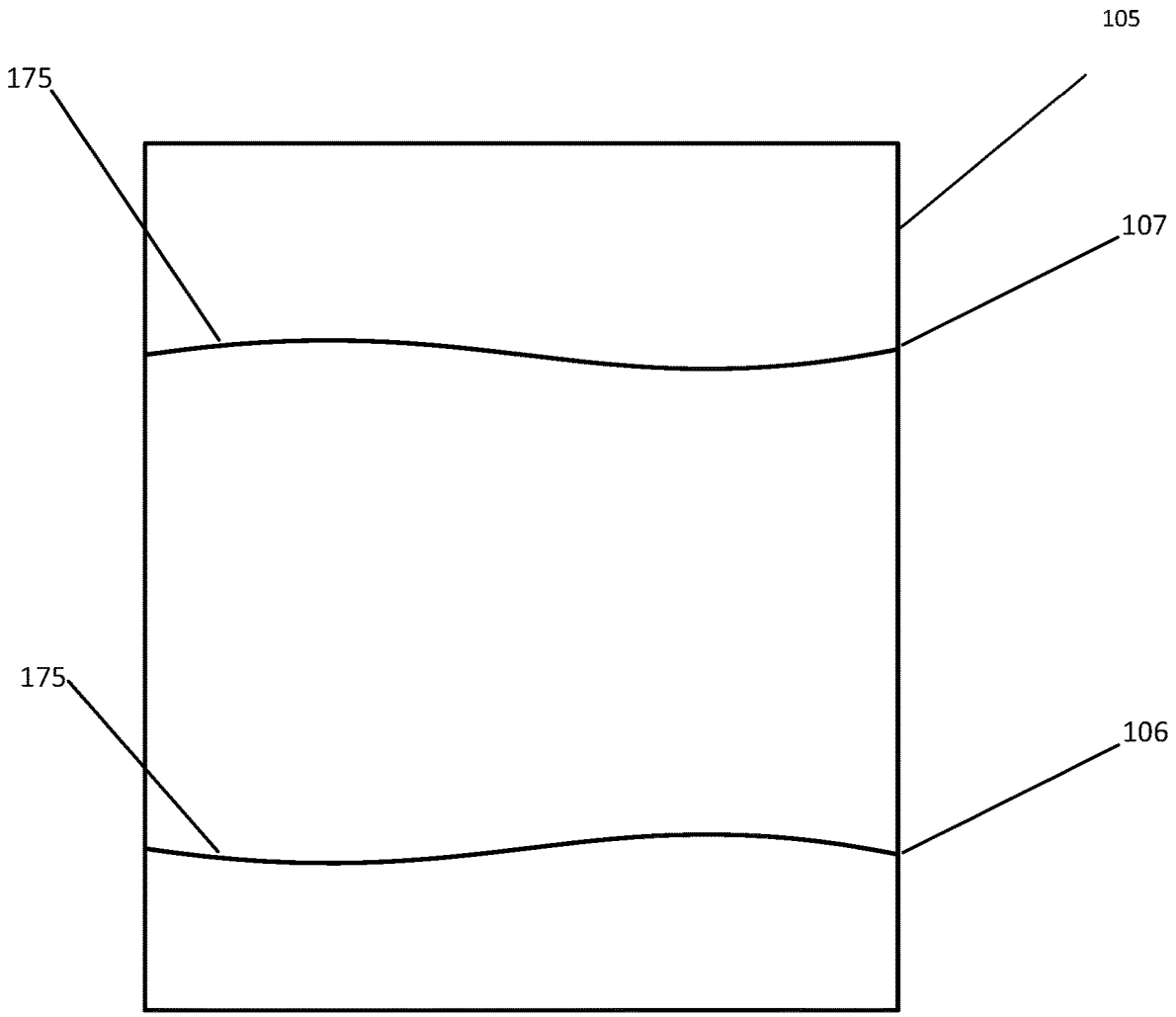
FIG. 8 is a schematic sketch of an example of the weight container showing the first predetermined level of fluid when the door is in the opened position (Lo) 106 and the second predetermined level of fluid when the door is in the closed position (Lc) 107.

FIG. 8 shows the fluid level in the weight container 105 at the first predefined level 106 and at the second predefined level 107. The predefined levels are determined during the setup phase to give the desired amount of force to the starting movement of the door when it is opening or closing.

CONCLUSION

The present invention controls the speed and movement of a garage door while it is opening or closing. It is able to do so by controlling the starting/stopping of the pumps relative to the door position. If the pumps are variable speed then the rate of fluid transfer is also a control variable. It does so while eliminating the common garage door opener with its inherent risks of a bearing or gear failing and of a power failure. The present invention takes advantage of gravity by altering counter weights to effect the controlled movement of a garage door.

The present invention is more economical (components and operation) and more reliable than the currently used technology of garage door openers. There are no hydraulic cylinders needed, with their seal issues, with the present invention. There are no heavy torque springs needed with the present invention. There are no gears to wear out or break. There are no bearings to wear out. The power needed to operate the system is significantly less than any other systems known (other than manual). That savings alone, when multiplied by the number of powered garage door openers in the world would save an immense amount of electricity every year.

While the term garage door has been used to assist in visualizing the present invention, the same technology can be applied to any type of heavy door or gate regardless of horizontal or vertical operation.

I claim:

1. A gravity powered door control system, the control system for controllably moving a door, the door having an opened position, the door having a closed position, the door having a bottom edge, the door having a first trigger, the door having a second trigger, the door having door guides, the door guides for limiting the door movement, the door guides having a first trip switch, the door guides having a second trip switch, the door guides having a third trip switch, the door guides having a fourth trip switch, the first trigger for tripping the first trip switch, the first trigger for tripping the second trip switch, the second trigger for tripping the third trip switch, the second trigger for tripping the fourth trip switch, the system having a switch, the switch for signaling the door to move between the opened position and the closed position, the switch connected to the system by any wired or wireless link, the system comprising:

(A) a holding tank, the holding tank containing a fluid, the holding tank having a holding level sensor, the holding level sensor for sensing the fluid level in the holding tank, the holding tank having a top side, the holding tank having a bottom side; and (B) a weight container, the weight container for holding the fluid, the weight container having a weight level sensor, the weight level sensor for sensing the fluid level in the weight container, the weight container having a top side, the weight container having a bottom side; and (C) a holding pump, the holding pump for transferring the fluid from the holding tank into the weight tank, the holding pump connected to the bottom side of the holding tank; and (D) a weight pump, the weight pump for transferring the fluid from the weight container into the holding tank, the weight pump connected to the bottom side of the weight container; and (E) a holding hose, the holding hose connecting the holding pump to the weight container, the holding hose for transferring the fluid from the holding tank to the weight container; and (F) a weight hose, the weight hose connecting the weight pump to the holding tank, the weight hose for transferring the fluid from the weight container to the holding tank; and (G) a power supply, the power supply for providing power to the pumps; and (H) a cable, the cable for connecting the top side of the weight container to the door, the cable for causing the door to move in the door guides as the amount of fluid transferred between the weight container and the holding tank changes; and (I) a plurality of cable guides, the cable guides arranged to cause the weight container to move vertically, the cable guides arranged to cause the door to move in the door guides; and (J) a controller for controlling the gravity powered door, the controller connected to:

(a) the holding level sensor, the holding level sensor for reporting the fluid level in the holding tank to the controller; and (b) the weight level sensor, the weight level sensor for reporting the fluid level in the weight container to the controller; and (c) the holding pump, the connection for controlling the speed of the holding pump; and (d) the weight pump, the connection for controlling the speed of the weight pump; and (e) the switch, the switch for signaling the controller to open or to close the door; and (f) the trip switches; and the controller designed and constructed to follow a pre-programmed set of logic commands, the logic commands to:

(a) cause the door to change from the opened position to the closed position by controlling the fluid transfer between the weight container and the holding tank; and (b) cause the door to change from the closed position to the opened position by controlling the fluid transfer between the holding tank and the weight container; and (c) control the speed of the door movement by controlling the rate of fluid transfer and the amount of fluid transfer, the fluid transfer between the weight container and the holding tank; and (d) monitor the fluid levels in the weight container and in the holding tank; and (e) transfer the fluid from the weight container to the holding tank when the door is in the open position and to transfer the fluid from the holding tank to the weight container when the door is in the closed position; and (f) transfer the fluid between the holding tank and the weight container under control of the pre-programmed set of logic commands; and (g) control the speed of the pumps when transferring the fluid; and (h) fill the weight container to a first predetermined level when the door is in the opened position; and (i) fill the weight container to a second predetermined level when the door is in the closed position; and whereby the gravity powered door may be controllably opened and closed by transferring the fluid between the holding tank and the weight container following the pre-programmed set of logic commands.

2. The gravity powered door control system of claim 1, wherein, the cable guides are pulleys for reducing friction on the cable when moving the door and the weight container.

3. The gravity powered door control system of claim 1, wherein, the control system-includes a door opened lock for locking the door to prevent movement when the door is approximately in the opened position and includes a door closed lock for locking the door to prevent movement when the door is approximately in the closed position.

4. The gravity powered door control system of claim 1, wherein, the control system includes an obstacle detector, the obstacle detector mounted at the bottom edge of the door, the obstacle detector for detecting obstacles while the door is closing.

5. The gravity powered door control system of claim 1, wherein, the control system includes an emergency brake, the emergency brake for causing the movement of the door to stop when the emergency brake is activated, said emergency brake is activated by a member of a group consisting of the switch and the obstacle detector.

6. The gravity powered door control system of claim 1, wherein, the control system includes at least one speed-reducing apparatus, the speed-reducing apparatus for reducing the speed of the opening of the door as the door approaches the opened door position, and the speed-reducing apparatus for reducing the speed of the closing of the door as the door approaches the closed door position, said speed-reducing apparatus is designed and constructed to be selected from a group consisting of a one directional speed-reducing apparatus and a two directional speed-reducing apparatus.

7. The gravity powered door control system of claim 1, wherein, the fluid consists of a liquid selected from a group consisting of water and water with agents added wherein the agents added is selected from the group consisting of preservatives, antifreeze agents, antirust agents and lubricant agents.

8. The gravity powered door control system of claim 1, wherein, the control system for controllably moving the door includes an emergency door opening apparatus, the emergency door opening apparatus consists of:

(a) an emergency door opening tank, the tank having a bottom side, the tank containing the fluid, the volume of the fluid approximately equal to the volume of the weight container; and (b) an emergency hose, the emergency hose having two ends, the first end connected to the bottom side of the emergency door opening tank, the second end connected to the top side of the weight container, the emergency hose having an internal diameter that is at least approximately three times larger than the internal diameter of the holding hose and the weight hose; and (c) an emergency release valve, the emergency release valve having an opened position and a closed position, the emergency release valve for keeping fluid in the emergency door opening tank when the emergency release valve is in the closed position and for causing the fluid in the emergency door opening tank to release and transfer into the weight container when the emergency release valve is in the open position; and whereby the weight container quickly fills with fluid when the emergency release valve is changed to the open position and thereby causing the door to quickly move to the opened position.

9. A gravity powered door control system, the control system for controllably moving a door, the door having an opened position, the door having a closed position, the door having a first trigger, the door having a second trigger, the door having door guides, the door guides for limiting the door movement, the door guides having a first trip switch, the door guides having a second trip switch, the door guides having a third trip switch, the door guides having a fourth trip switch, the first trigger for tripping the first trip switch, the first trigger for tripping the second trip switch, the second trigger for tripping the third trip switch, the second trigger for tripping the fourth trip switch, the system having a switch, the switch for signaling the door to move between the opened position and the closed position, the switch connected to the system by any wired or wireless link, the system comprising:

(A) a holding tank, the holding tank containing a fluid, the holding tank having a holding level sensor, the holding level sensor for sensing the fluid level in the holding tank, the holding tank having a top side, the holding tank having a bottom side; and (B) a weight container, the weight container for holding the fluid, the weight container having a weight level sensor, the weight level sensor for sensing the fluid level in the weight container, the weight container having a top side, the weight container having a bottom side; and (C) a reversible pump, the reversible pump for transferring the fluid between the holding tank and the weight tank; and (D) a holding hose, the holding hose connecting the holding tank to the reversible pump; and (F) a weight hose, the weight hose connecting the bottom side of the weight container to the reversible pump; and (G) a power supply, the power supply for providing power to the reversible pump; and (H) a cable, the cable for connecting the top side of the weight container to the door, the cable for causing the door to move in the door guides as the amount of fluid transferred between the weight container and the holding tank changes; and (I) a plurality of cable guides, the cable guides arranged to cause the weight container to move vertically, the cable guides arranged to cause the door to move in the door guides; and (J) a controller for controlling the gravity powered door, the controller connected to:

(a) the holding level sensor, the holding level sensor for reporting the fluid level in the holding tank to the controller; and (b) the weight level sensor, the weight level sensor for reporting the fluid level in the weight container to the controller; and (c) the reversible pump, the connection for controlling the speed of the reversible pump; and (d) the switch, the switch for signaling the controller to open or to close the door; and (e) the trip switches; and the controller designed and constructed to follow a pre-programmed set of logic commands, the logic commands to:

(a) cause the door to change from the opened position to the closed position by controlling the fluid transfer between the weight container and the holding tank; and (b) cause the door to change from the closed position to the opened position by controlling the fluid transfer between the holding tank and the weight container; and (c) control the speed of the door movement by controlling the rate of fluid transfer and the amount of fluid transfer, the fluid transfer between the weight container and the holding tank; and (d) monitor the fluid levels in the weight container and in the holding tank; and (e) transfer the fluid from the weight container to the holding tank when the door is in the open position and to transfer the fluid from the holding tank to the weight container when the door is in the closed position; and (f) transfer the fluid between the holding tank and the weight container under control of the pre-programmed set of logic commands; and (g) control the speed of the reversible pump when transferring the fluid; and (h) fill the weight container to a first predetermined level when the door is in the opened position; and (i) fill the weight container to a second predetermined level when the door is in the closed position; and whereby the gravity powered door may be controllably opened and closed by transferring the fluid between the holding tank and the weight container following the pre-programmed set of logic commands.

10. The gravity powered door control system of claim 9, wherein, the cable guides are pulleys for reducing friction on the cable when moving the door and the weight container.

11. The gravity powered door control system of claim 9, wherein, the control system includes a door opened lock for locking the door to prevent movement when the door is approximately in the opened position and includes a door closed lock for locking the door to prevent movement when the door is approximately in the closed position.

12. The gravity powered door control system of claim 9, wherein, the control system includes an obstacle detector, the obstacle detector mounted at the bottom edge of the door, the obstacle detector for detecting obstacles while the door is closing.

13. The gravity powered door control system of claim 9, wherein, the control system includes an emergency brake, the emergency brake for causing the movement of the door to stop when the emergency brake is activated, said emergency brake is activated by a member of a group consisting of the switch and the obstacle detector.

14. The gravity powered door control system of claim 9, wherein, the control system includes at least one speed-reducing apparatus, the speed-reducing apparatus for reducing the speed of the opening of the door as the door approaches the opened door position, and the speed-reducing apparatus for reducing the speed of the closing of the door as the door approaches the closed door position, said speed-reducing apparatus is designed and constructed to be selected from a group consisting of a one directional speed-reducing apparatus and a two directional speed-reducing apparatus.

15. The gravity powered door control system of claim 9, wherein, the fluid consists of a liquid selected from a group consisting of water and water with agents added wherein the agents added is selected from the group consisting of preservatives, antifreeze agents, antirust agents and lubricant agents.

16. The gravity powered door control system of claim 9, wherein, the control system includes an emergency door opening apparatus, the emergency door opening apparatus consists of:

(a) an emergency door opening tank, the tank having a bottom side, the tank containing the fluid, the volume of the fluid approximately equal to the volume of the weight container; and (b) an emergency hose, the emergency hose having two ends, the first end connected to the bottom side of the emergency door opening tank, the second end connected to the top side of the weight container, the emergency hose having an internal diameter that is at least approximately three times larger than the internal diameter of the holding hose and the weight hose; and (c) an emergency release valve, the emergency release valve having an opened position and a closed position, the emergency release valve for keeping fluid in the emergency door opening tank when the emergency release valve is in the closed position and for causing the fluid in the emergency door opening tank to release and transfer into the weight container when the emergency release valve is in the open position; and whereby the weight container quickly fills with fluid when the emergency release valve is changed to the open position and thereby causing the door to quickly move to the opened position.

17. A gravity powered door control method, the control method for controllably moving a door, the door having an opened position, the door having a closed position, the door having a first trigger, the door having a second trigger, the door having door guides, the door guides for limiting the door movement, the door guides having a first trip switch, the door guides having a second trip switch, the door guides having a third trip switch, the door guides having a fourth trip switch, the first trigger for tripping the first trip switch, the first trigger for tripping the second trip switch, the second trigger for tripping the third trip switch, the second trigger for tripping the fourth trip switch, the method having a switch, the switch for signaling the door to move between the opened position and the closed position, the switch connected to the method by any wired or wireless link, the method comprising:

(A) providing a holding tank, the holding tank containing a fluid, the holding tank having a holding level sensor, the holding level sensor for sensing the fluid level in the holding tank, the holding tank having a top side, the holding tank having a bottom side; and (B) providing a weight container, the weight container for holding the fluid, the weight container having a weight level sensor, the weight level sensor for sensing the fluid level in the weight container, the weight container having a top side, the weight container having a bottom side; and (C) providing a reversible pump, the reversible pump for transferring the fluid between the holding tank and the weight tank; and (D) providing a holding hose, the holding hose connecting the bottom side of the holding tank to the reversible pump; and (F) providing a weight hose, the weight hose connecting the bottom side of the weight container to the reversible pump; and (G) providing a power supply, the power supply for providing power to the reversible pump; and (H) providing a cable, the cable for connecting the top side of the weight container to the door, the cable for causing the door to move in the door guides as the amount of fluid transferred between the weight container and the holding tank changes; and (I) providing a plurality of cable guides, the cable guides arranged to cause the weight container to move vertically, the cable guides arranged to cause the door to move in the door guides; and (J) providing a controller for controlling the gravity powered door, the controller connected to:

(a) the holding level sensor, the holding level sensor for reporting the fluid level in the holding tank to the controller; and (b) the weight level sensor, the weight level sensor for reporting the fluid level in the weight container to the controller; and (c) the reversible pump, the connection for controlling the speed of the reversible pump; and (d) the switch, the switch for signaling the controller to open or to close the door; and (e) the trip switches; and the controller designed and constructed to follow a pre-programmed set of logic commands, the logic commands to:

(a) cause the door to change from the opened position to the closed position by controlling the fluid transfer between the weight container and the holding tank; and (b) cause the door to change from the closed position to the opened position by controlling the fluid transfer between the holding tank and the weight container; and (c) control the speed of the door movement by controlling the rate of fluid transfer and the amount of fluid transfer, the fluid transfer between the weight container and the holding tank; and (d) monitor the fluid levels in the weight container and in the holding tank; and (e) transfer the fluid from the weight container to the holding tank when the door is in the open position and to transfer the fluid from the holding tank to the weight container when the door is in the closed position; and (f) transfer the fluid between the holding tank and the weight container under control of the pre-programmed set of logic commands; and (g) control the speed of the reversible pump when transferring the fluid; and (h) fill the weight container to a first predetermined level when the door is in the opened position; and (i) fill the weight container to a second predetermined level when the door is in the closed position; and whereby the gravity powered door may be controllably opened and closed by transferring the fluid between the holding tank and the weight container following the pre-programmed set of logic commands.

18. The gravity powered door control method of claim 17, wherein the cable guides are pulleys for reducing friction on the cable when moving the door and the weight container.

19. The gravity powered door control method of claim 17, wherein, the control method includes a door opened lock for preventing door movement when the door is approximately in the opened position and wherein the control method includes a door closed lock for preventing door movement when the door is approximately in the closed position.

20. The gravity powered door control method of claim 17, wherein, the control method includes an obstacle detector, the obstacle detector mounted at the bottom edge of the door, the obstacle detector for detecting obstacles while the door is closing.

21. The gravity powered door control method of claim 17, wherein, the control method includes an emergency break, the emergency break for causing the movement of the door to stop when the emergency brake is activated, said emergency brake is activated by a member of a group consisting of the switch and the obstacle detector.

22. The gravity powered door control method of claim 17, wherein, the control method includes at least one speed-reducing apparatus, the speed-reducing apparatus for reducing the speed of the opening of the door as the door approaches the opened door position, and the speed-reducing apparatus for reducing the speed of the closing of the door as the door approaches the closed door position, said speed-reducing apparatus is designed and constructed to be selected from a group consisting of a one directional speed-reducing apparatus and a two directional speed-reducing apparatus.

23. The gravity powered door control method of claim 17, wherein the fluid consists of a liquid selected from a group consisting of water and water with agents added wherein the agents added is selected from the group consisting of preservatives, antifreeze agents, antirust agents and lubricant agents.

24. The gravity powered door control method of claim 17, wherein, the control method includes an emergency door opening apparatus, the emergency door opening apparatus consists of:

(a) an emergency door opening tank, the tank having a bottom side, the tank containing the fluid, the volume of the fluid approximately equal to the volume of the weight container; and (b) an emergency hose, the emergency hose having two ends, the first end connected to the bottom side of the emergency door opening tank, the second end connected to the top side of the weight container, the emergency hose having an internal diameter that is at least approximately three times larger than the internal diameter of the holding hose and the weight hose; and (c) an emergency release valve, the emergency release valve having an opened position and a closed position, the emergency release valve for keeping fluid in the emergency door opening tank when the emergency release valve is in the closed position and for causing the fluid in the emergency door opening tank to release and transfer into the weight container when the emergency release valve is in the open position; and whereby the weight container quickly fills with fluid when the emergency release valve is changed to the open position and thereby causing the door to quickly move to the opened position.

* * * * *